US006540305B2

(12) United States Patent
Phillips

(10) Patent No.: US 6,540,305 B2
(45) Date of Patent: Apr. 1, 2003

(54) ELECTRIC FLOOR COVERING REMOVAL APPARATUS

(76) Inventor: Edward W. Phillips, 1243 Bellview Rd., Jonesville, TX (US) 75659

( * ) Notice: Subject to any disclaimer, the term of this patent is extended or adjusted under 35 U.S.C. 154(b) by 44 days.

(21) Appl. No.: 09/804,562

(22) Filed: Mar. 8, 2001

(65) Prior Publication Data

US 2002/0109394 A1 Aug. 15, 2002

Related U.S. Application Data

(60) Provisional application No. 60/190,527, filed on Mar. 20, 2000.

(51) Int. Cl.[7] ..... B32B 31/18; E21C 47/00

(52) U.S. Cl. ..... 299/36.1; 15/93.1; 30/170

(58) Field of Search ..... 299/36.1, 37.1; 15/93.1; 30/169–170; 81/45

(56) References Cited

U.S. PATENT DOCUMENTS

| | | | | | |
|---|---|---|---|---|---|
| 3,996,999 | A | * | 12/1976 | Termont et al. | 165/41 |
| 4,053,958 | A | | 10/1977 | Taylor | 15/93 R |
| 4,394,052 | A | | 7/1983 | Adams et al. | 299/18 |
| 5,033,796 | A | | 7/1991 | Odean | 299/37 |
| 5,190,398 | A | * | 3/1993 | Swisher, Jr. | 404/90 |
| 5,197,784 | A | * | 3/1993 | Holder | 299/37.1 |
| 5,219,275 | A | * | 6/1993 | Ribaudo | 417/291 |
| 5,632,174 | A | * | 5/1997 | Hunter | 72/129 |
| 5,641,206 | A | | 6/1997 | Craft | 299/37.1 |
| 5,713,637 | A | | 2/1998 | Worden et al. | 299/37.1 |
| 5,772,284 | A | | 6/1998 | Lindsey et al. | 299/36.1 |
| 5,830,313 | A | | 11/1998 | Smith | 156/584 |
| 6,102,022 | A | * | 8/2000 | Schave | 125/13.01 |
| 6,273,513 | B1 | * | 8/2001 | Pope | 299/36.1 |

* cited by examiner

*Primary Examiner*—Heather Shackelford
*Assistant Examiner*—Sunil Singh
(74) *Attorney, Agent, or Firm*—John M. Harrison

(57) ABSTRACT

An electric floor covering removal apparatus which is characterized typically by an electric motor fitted in a frame for driving a fan, a pair of hydrostatic pumps hydraulically connected to independent, hydraulically-operated wheel motors and a hydraulic gear pump for raising and lowering a landing gear with respect to the frame, deploying the floor covering engaging-implements of the apparatus and driving the apparatus to remove the floor covering. A pair of control arm levers are spring-loaded to neutral and serve to independently operate the hydrostatic pumps and the wheel motors in infinitely variable fashion, in both the forward and reverse directions. The driver's seat is mounted on an insulated cover or shroud that covers the electric motor, hydrostatic pumps and the hydraulic gear pump, as well as electrical gear and a hydraulic fluid reservoir located beneath these operating components. An electric cord handling system, pneumatic rear tires and accessory equipment complete the electric floor covering removal apparatus.

15 Claims, 16 Drawing Sheets

ELECTRIC FLOOR COVERING REMOVAL APPARATUS

CROSS-REFERENCE TO RELATED APPLICATIONS

This application claims the benefit of abandoned U.S. Provisional Application Serial No. 60/190,527, filed Mar. 20, 2000.

BACKGROUND OF THE INVENTION

1. Field of the Invention

This invention relates to a floor covering removal apparatus and more particularly, to an electric floor covering removal apparatus which is typically characterized by a five horsepower, TEFC (totally enclosed, fan-cooled), 220 volt, single phase, 30 amp, ground fault-compatible electric motor for driving a pair of hydrostatic pumps independently connected to a pair of hydraulic wheel motors operated by a control arm lever steering system, for independently operating the hydrostatic pumps and the wheel motors and driving a pair of pneumatic rear tires. The electric motor also drives a fan and a hydraulic gear pump for cooling the hydraulic system and raising and lowering a landing gear system by means of hydraulic cylinders. A hydraulic fluid reservoir is disposed beneath the electric motor, hydrostatic pumps and the hydraulic gear pump and a floor covering removal system, including a blade for engaging and removing floor tile, is adjustably mounted on the front of the electric floor covering removal apparatus for contacting and traversing the floor and removing the tile or other floor covering, in a controlled manner. The shroud or housing of the device is insulated and cooled and the driver's seat is positioned on the shroud or housing, for optimum operator comfort. Pneumatic tires are provided on the rear of the apparatus in association with the independently-operated drive motors to further optimize traction and operator comfort. A power cord management system is provided on the apparatus in the form of a swinging boom and a light is attached to the blade angle adjustment system which raises and lowers the blade or alternative floor covering-engaging device, for illuminating the working area. The electric floor covering removal apparatus is sized to fit in most passenger elevators, as well as doors as small as 34 inches in width, and is therefore easily transportable to various floors of a multi-floor building and operated inside the structure without undesirable emissions that accompany gasoline and low pressure gas-powered floor covering removal machines.

2. Description of the Prior Art

Various floor covering removal apparatus are well known in the art. These machines range from the simple to the complex and in one of the more simple embodiments, include the surface preparation machine detailed in U.S. Pat. No. 4,053,958. This device includes a tool (blade, chisel or sanding attachment) attached to a tool holder. The tool holder is, in turn, attached by a bearing to a shaft which passes through a flywheel and the shaft is offset from the center of the flywheel, causing an eccentric rotation of the tool holder. The flywheel and tool holder "float" as an assembly on rubber couplings and impart to the tool components the various motions of slicing, chopping, scraping and rubbing. U.S. Pat. No. 4,394,052, details a "Carpet Take-Up Device" for use on carpeting that has been glued down. The device includes a spool, an apparatus for rotating the spool, a blade adapted to wedge beneath the carpet and having a knife at each of opposite longitudinal ends, a roller bar and a rear wheel support. The rotation apparatus rotates a spool to roll up the carpet as the blade is pulled forwardly beneath the carpet. U.S. Pat. No. 5,033,796, dated Jul. 23, 1991, details a power-operated floor stripping apparatus having a frame, a drive provided on the frame, wheels supporting the frame, a handle to guide the frame and a cutter blade carried by a head which is pivotally mounted to the frame. The head has a lower end facing the floor upper and lower plates carried by the head at the lower end to grip the cutter blade and two posts carried by the lower plate to project upwardly through the openings formed in the upper plate, along with sleeves extending around the post above the upper plate. Nuts are attached to the post for tightening to transmit an upward force to the post and a downward force to the sleeves, such that the plates are caused to grip the blade, which has a cutting edge. U.S. Pat. No. 5,641,206, dated Jun. 24, 1997, to Craft, details spool valve-operated apparatus for removing a surface layer from a floor, which includes a body rear weight bearing guide wheels and a front weight bearing wheel. A front weight bearing scraping apparatus is pivotally mounted on the body by a cylinder and the body can be raised and lowered to apply weight to a blade contacting the floor. U.S. Pat. No. 5,713,637, dated Feb. 3, 1998, to Worden et al, details a "walk behind" tractor having a power take-off and a blade assembly for contacting a floor or surface and removing the floor covering from the surface. A multi-purpose, horizontal surface stripper is detailed in U.S. Pat. No. 5,772,284, dated Jun. 30, 1998. The apparatus includes a chassis having a frame, a stripping assembly, a drive assembly and a hydraulic system for controlling the operation of the stripping and drive assemblies. A blade is also provided in a blade mount and a carrier with a roll axle extending through the carrier for changing the roll of the blade. U.S. Pat. No. 5,830,313, dated Nov. 3, 1998, details a self-propelled floor covering scraper machine having front and rear wheels and a drive mechanism for forward or reverse motion. A scraper blade is attached to the front of the device and a mechanism for controlling the steering is also provided.

It is an object of this invention to provide a new and improved electric floor covering removal apparatus which is sized to fit in conventional passenger elevators and doors as small as 34 inches in width and can be quickly and easily transported to various floors of a multi-floor building and used without fear of creating unhealthy emissions in the building.

Another object of the invention is to provide a new and improved zero turning radius electric floor covering removal apparatus which has an exceptionally low center of gravity and is capable of removing various types of floor covering, including one or more layers of floor tile, carpet and the like, and is further characterized by an electric or diesel motor which drives a fan, a pair of independently-controlled, infinitely-variable hydrostatic pumps connected to independent wheel motors for driving rear wheels having pneumatic tires and a hydraulic gear pump for raising and lowering the landing gear of the apparatus during operation of the machine.

A still further object of this invention is providing an electric floor covering removal apparatus which includes a seat interlock switch and a key switch and indicator light, a pivoting landing gear, an insulated, internally-cooled shroud or housing, rear wheels with pneumatic or foam-filled tires and independently-controlled wheel motors powered by independent, infinitely variable hydrostatic pumps for driving the rear wheels, driven by a typically five horsepower electric motor, which device is fitted with a power cord management boom, a light, and a hydraulic fluid or oil reservoir, as well as an adjustable blade or floor covering removal device provided on the blade.

SUMMARY OF THE INVENTION

These and other objects of the invention are provided in a new and improved, riding electric floor covering removal apparatus which is sized to fit in a conventional passenger elevator and doors as small as 34 inches in width and can be transported to any desired floor in a multi-story building and is used in a preferred embodiment without fear of causing undesirable, unhealthy emissions. In this preferred embodiment the device is characterized by a five horsepower, 220 volt, single-phase, 30 amp, ground fault-compatible electric motor which drives a pair of hydrostatic pumps, independently controlled by handles that further independently control separate wheel motors attached to a rear wheel motor mount box axle which mounts a pair of rear wheels with pneumatic tires. The electric motor also drives a fan that circulates air through the insulated housing and cools the hydraulic system, as well as a hydraulic gear pump that controls a pair of hydraulic cylinders for raising and lowering a pivotally-mounted landing gear in the apparatus. The cooling system provides exceptional operator comfort and low temperature operation of hydraulic components. The blade or alternative floor covering engaging and removal device can be mechanically adjusted into and from the floor covering from the operator's seat and may be fitted with a light, and a pivoting electric cord handling boom is provided for deploying the electric cord in the appropriate location as the apparatus is operated.

BRIEF DESCRIPTION OF THE DRAWINGS

The invention will be better understood by reference to the accompanying drawings, wherein.

DESCRIPTION OF THE PREFERRED EMBODIMENTS

Figure 1:
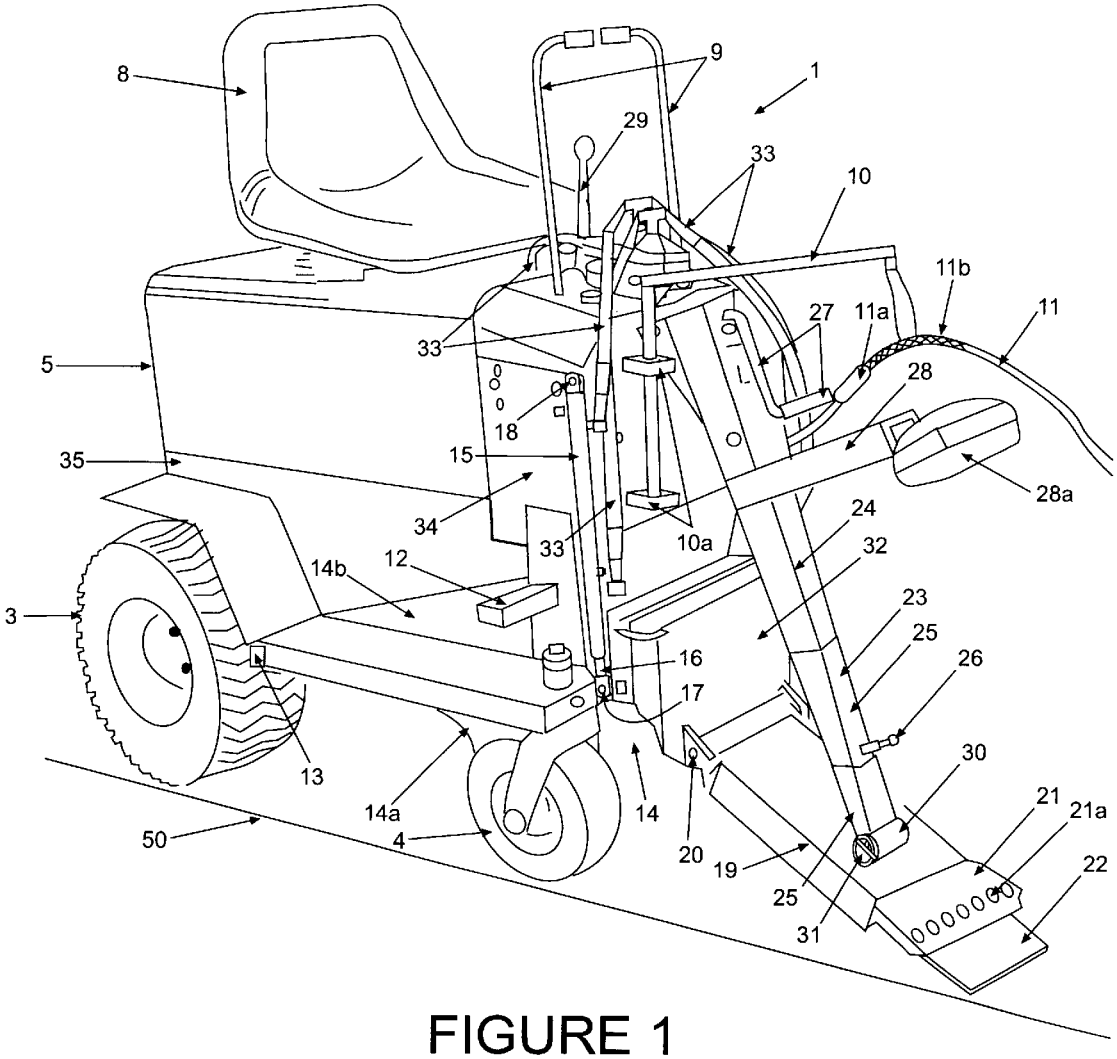
FIG. 1 is a front perspective view of a preferred embodiment of the electric floor covering removal apparatus of this invention.
Figure 1A:
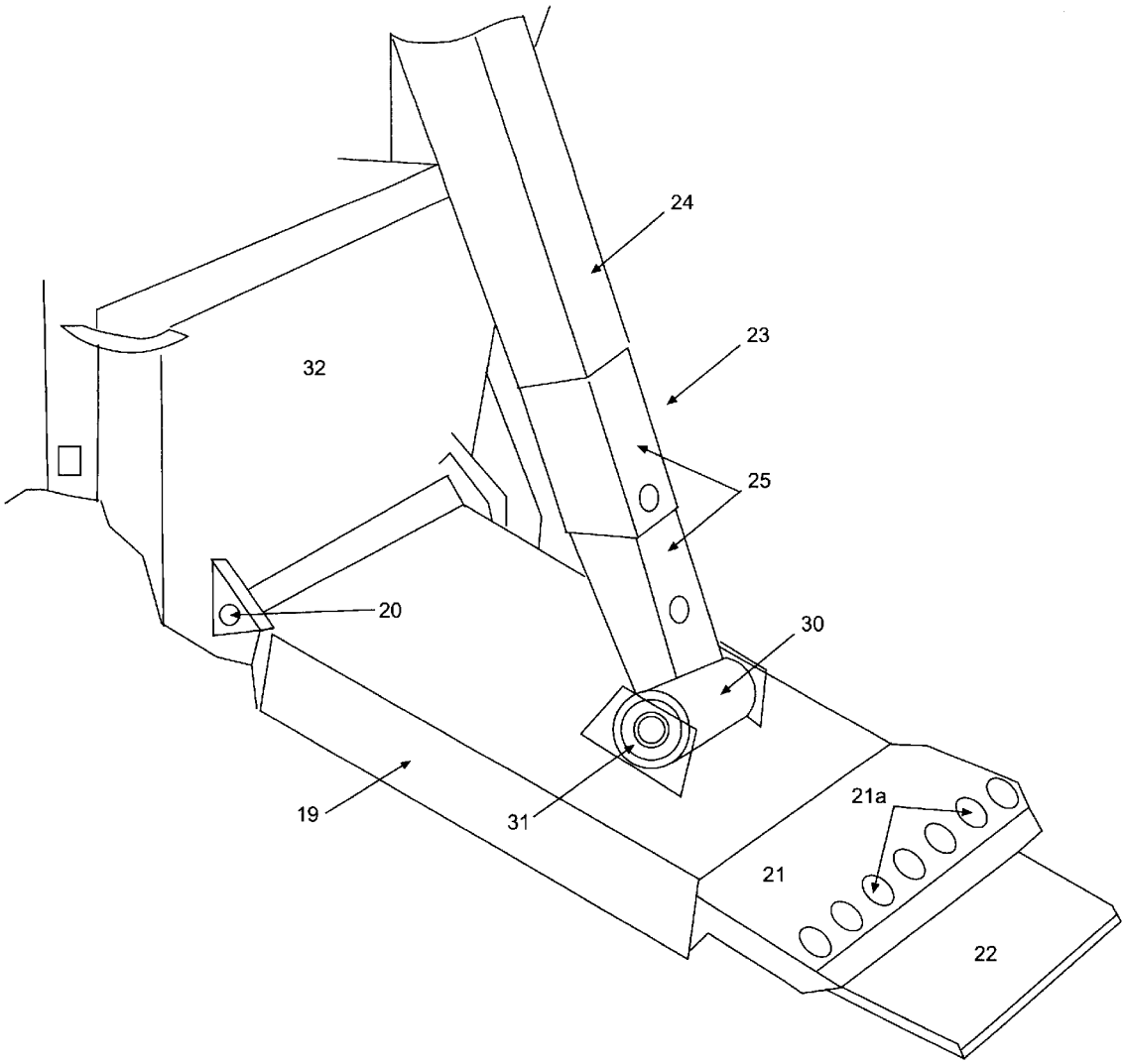
FIG. 1A is a perspective view of a typical blade and blade adjusting assembly on the blade angle adjustment assembly of the electric floor covering removal apparatus illustrated in FIG. 1.
Figure 2:
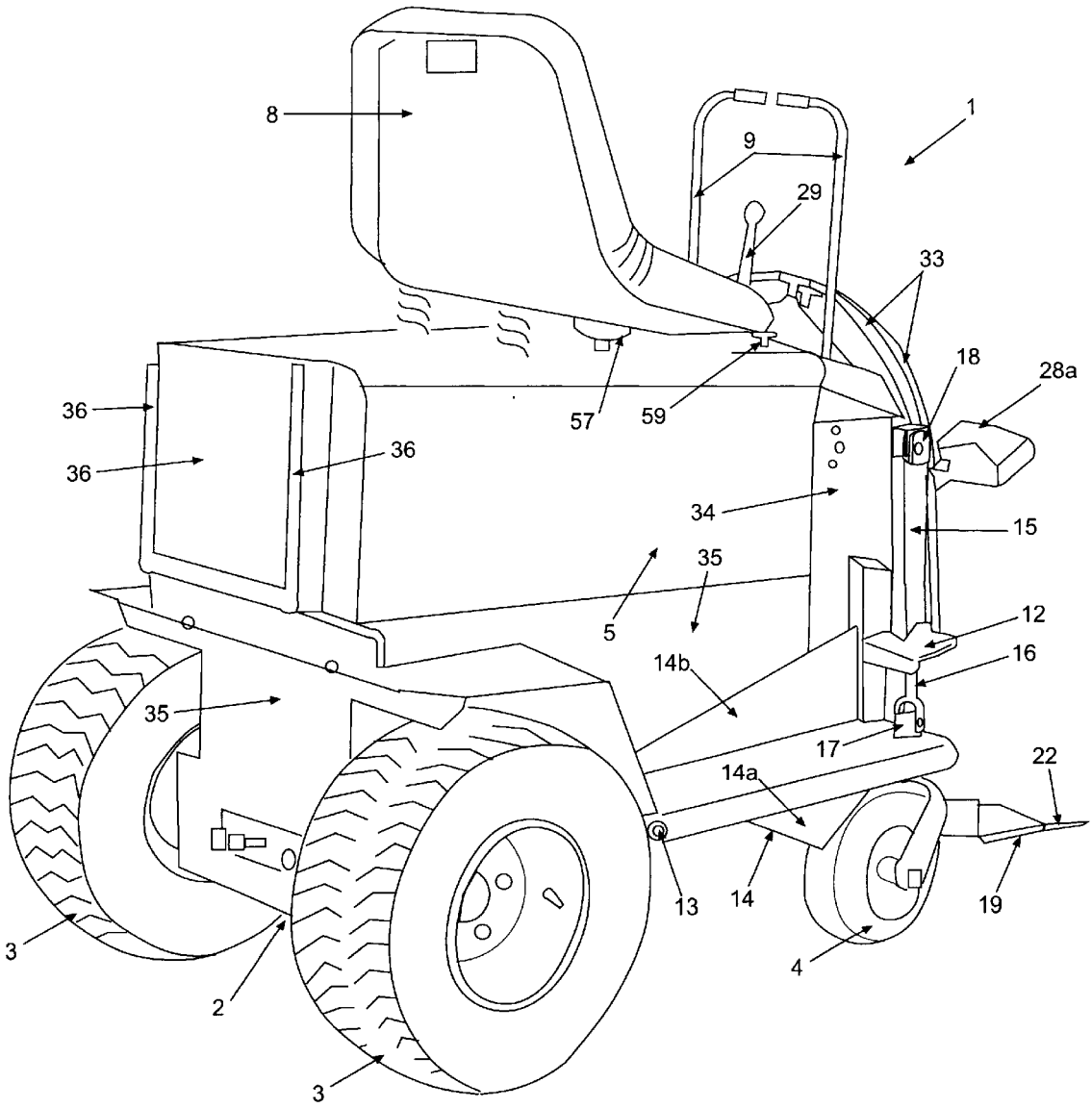
FIG. 2 is a rear perspective view of the electric floor covering removal apparatus illustrated in FIG. 1.

Referring initially to FIGS. 1, 1A and 2 of the drawings in a preferred embodiment, the electric floor covering removal apparatus of this invention is generally illustrated by reference numeral 1. The electric floor covering removal apparatus 1 includes a frame 2 having support struts 2*a* (FIG. 3), rear wheels 3, with inflatable tires, which rear wheels 3 are separately rotatable on independent wheel motor mount box axles 3*a* and a pair of front castor wheels 4 are pivotally and rotatably mounted on a landing gear 14, pivoted on the frame 2. A cowling, housing or shroud 5 is removably attached to the frame 2 and a driver's seat 8 is mounted on top of the cowling 5, and includes a seat interlock switch 57 and an on-off switch and associated indicator light 59, as further illustrated in FIGS. 1 and 2. A pair of steering arms 9 project upwardly from the frame 2 forwardly of the driver's seat 8 and a landing gear control 29 likewise extends upwardly, typically rearwardly of the steering arms 9 to raise and lower the landing gear 14, as hereinafter further described. The landing gear 14 is pivoted to the frame 2 at a landing gear pivot pin 13. A blade angle plate 19 is pivotally attached to the frame 2 by means of a plate pivot pin 20 and includes a blade adjustment assembly 23, one end of which is attached to the blade angle plate 19 and the opposite end to the upper portion of the frame 2. The blade adjustment assembly 23 includes a base tubing 24 and a telescoping tubing 25, the latter of which is telescopically attached to the base tubing 24 and is fitted with a shock-absorbing tubing mount 30, which is attached to the blade angle plate 19 and is fitted with a shock absorber bushing 31 and a bushing retainer ring 31*a* (FIG. 2B). A release pin 26 serves to secure the telescoping tubing 25 in a selectively extended configuration with respect to the base tubing 24. A crank 27 is provided with a gear mechanism (not illustrated) located in the top of the base tubing 24, to facilitate extension and retraction of the telescoping tubing 25 into and from the base tubing 24 and adjust the height of the blade angle plate 19 responsive to rotation of the crank 27, as hereinafter further described. A light bracket 28 extends from the base tubing 24 element of the blade adjustment assembly 23 and includes a light 28*a*, for illuminating the work area forwardly of the blade 22, which is secured in position on the extending end of the blade angle plate 19 by means of blade mounts 21. In a preferred embodiment the blade 22 is mounted in position on the blade mount 21 by means of blade mount bolts 21*a* in conventional fashion.

The landing gear 14 further includes a pair of landing gear cross-frames 14*a,* supporting corresponding foot safety plates 14*b*, as illustrated in FIG. 2, as well as a pair of landing gear cylinders 15, each cylinder element of which is attached to the frame 2 by means of a cylinder bracket 18 and the extending cylinder pistons 16 of which are connected to the landing gear 14 by means of piston brackets 17, respectively, as further illustrated in FIGS. 1 and 1A. One or more weight blocks (not illustrated) may be added to the weight assembly mount plate 32, in order to add weight to the blade angle plate 19 and thus supply sufficient downward pressure on the blade 22 during operation of the electric floor covering removal apparatus 1, as hereinafter further described. As illustrated in FIGS. 1 and 2B, a foot rest 12 is provided on each side of the landing gear 14 for supporting the feet of a driver (not illustrated) seated on the driver's seat 8 and the foot safety plates 14*b* serve to protect the driver's feet during operation of the apparatus. A landing gear pivot pin 13 serves to pivotally attach the landing gear 14 to the frame 2 and facilitate additional pressure applied to the blade 22 by raising the landing gear 14 through operation of the two landing gear cylinders 15 and bringing the entire weight of the electric floor covering removal apparatus 1 and the driver, to bear on the blade 22 and the rear wheels 3, as further hereinafter described. A power cord boom 10 is pivotally attached to the front end of the frame 2 by means of boom brackets 10*a* as illustrated in FIGS. 1 and 2*c*, and supports a power cord 11, attached to the apparatus attachment at a cord receptacle 11*a*, to supply power to the electric floor covering removal apparatus 1. A braided strain relief 11*b* is fitted on the power cord 11 below the cord receptacle 11*a*, to prevent stress failure of the power cord 11 during multiple flexures from operation of the power cord boom 10.

Figure 2A:
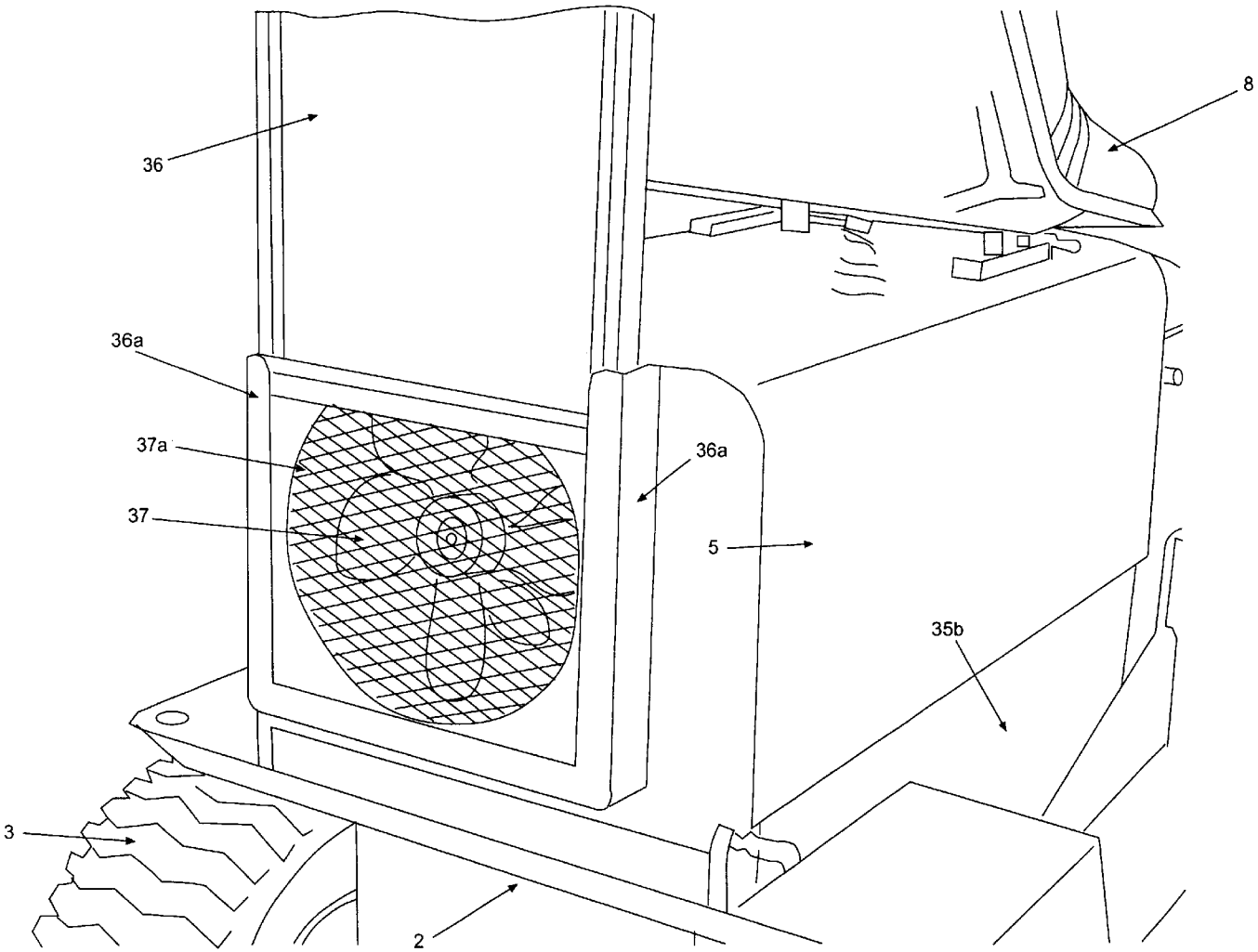
FIG. 2A is a rear view of the rear portion of the electric floor covering removal apparatus illustrated in FIG. 1, more particularly illustrating the air filter and fan elements of the apparatus.
Figure 2B:
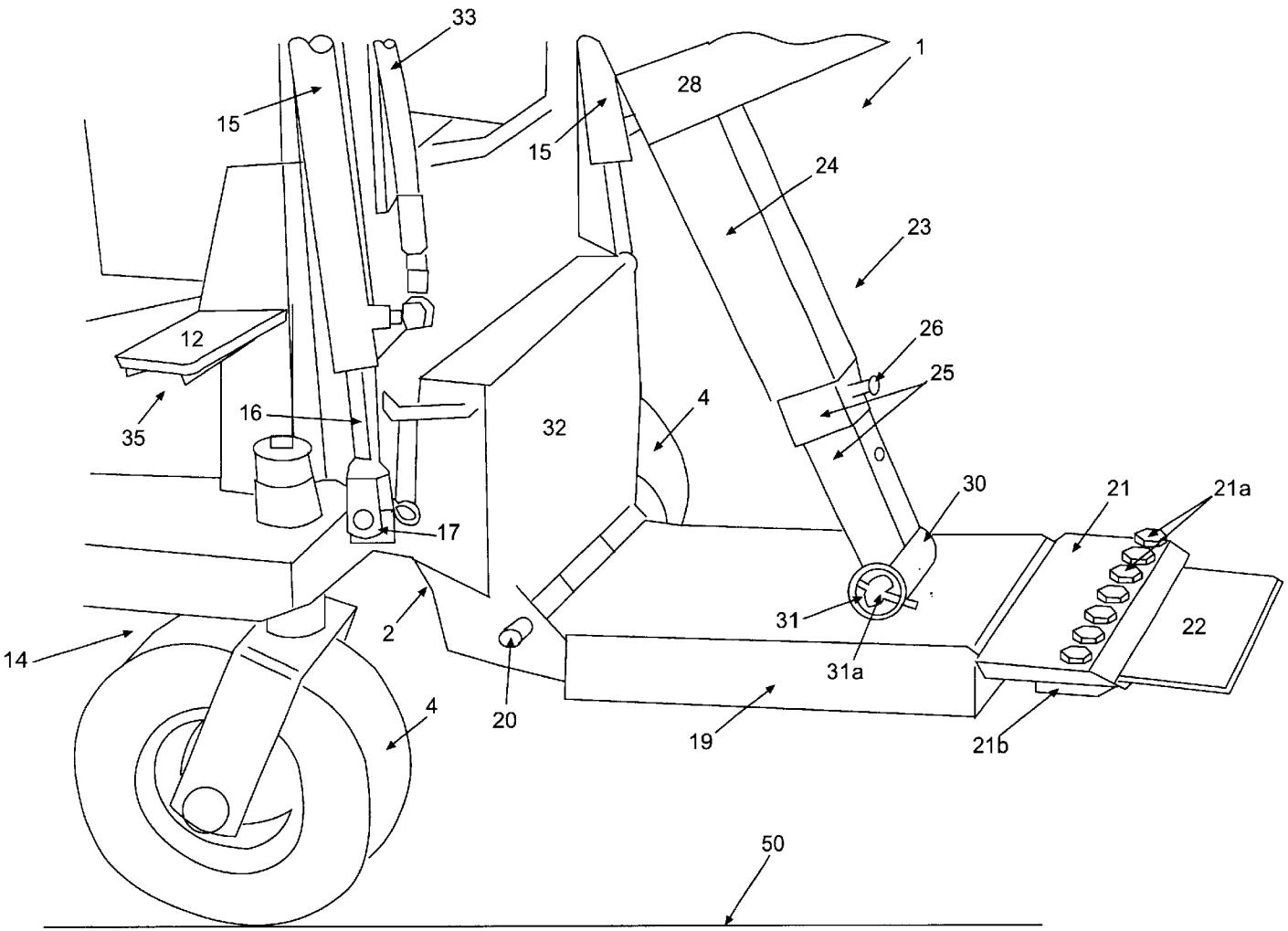
FIG. 2B is a perspective view of the landing gear and blade assembly elements of the electric floor covering removal apparatus illustrated in FIG. 1, with the blade assembly in raised configuration.
Figure 2C:
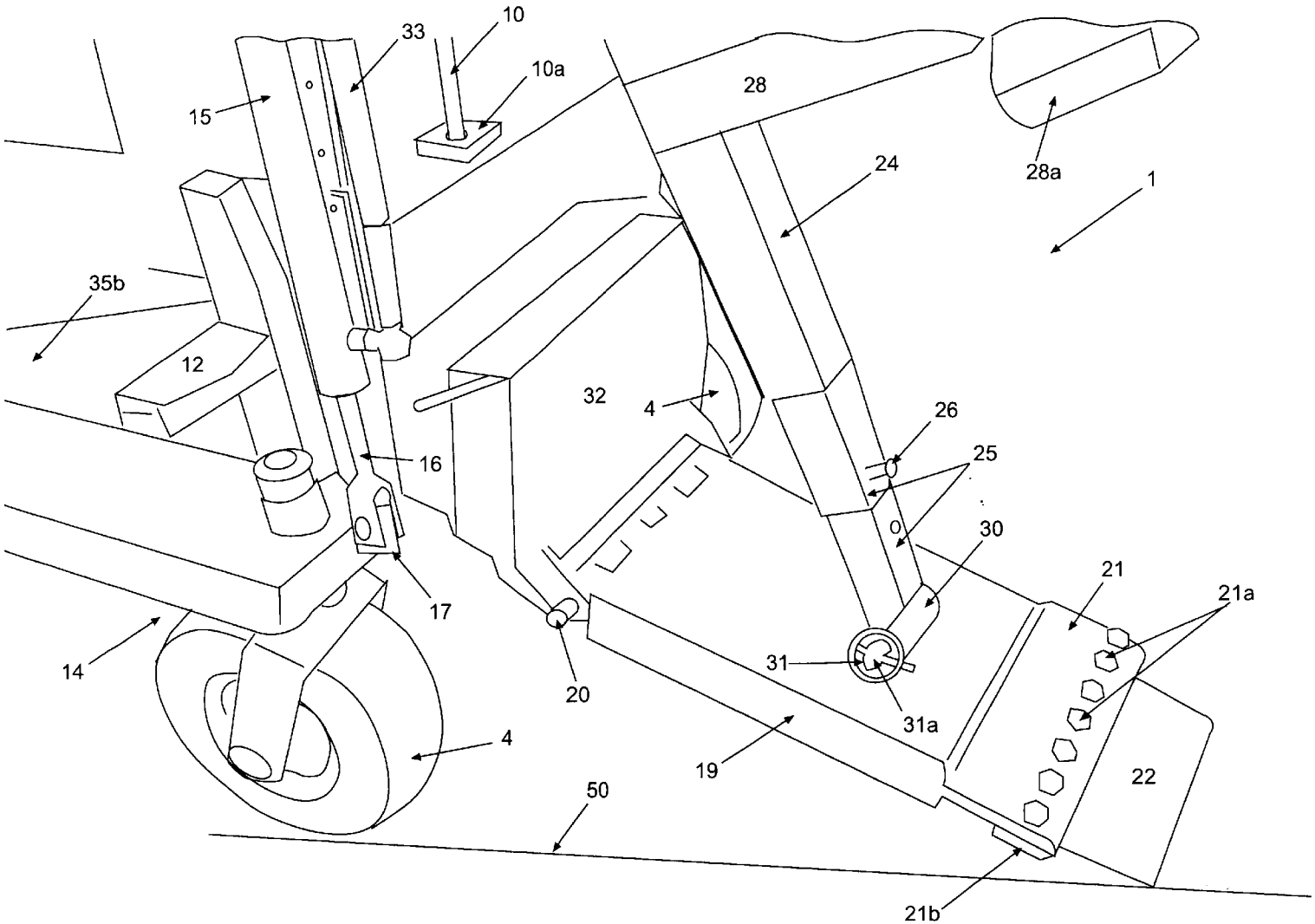
FIG. 2C is a perspective view of the landing gear and blade assembly of the electric floor covering removal apparatus illustrated in FIG. 1, with the blade assembly in downwardly deployed, functional configuration.

Referring now to FIG. 2A of the drawings, in a preferred embodiment an air filter 36 is slidably mounted in a filter bracket 36*a* to facilitate filtering air pulled through the fan grill 37*a* by a cooling fan 37, having a fan shaft 37*b*, for cooling the internal operating components of the electric floor covering removal apparatus 1, as further hereinafter described. As further illustrated in FIGS. 1–2A and 9, a hydraulic fluid reservoir 35 is disposed beneath a reservoir cowling 35*b* and is designed to hold a supply of hydraulic fluid or oil (not illustrated), for operating the dual landing gear cylinders 15 to raise and lower the landing gear 14 and operate other components of the electric floor covering removal apparatus 1, as hereinafter further described.

A drain plug 35*a* is provided in the bottom of the hydraulic fluid reservoir 35 for draining hydraulic fluid from the reservoir.

Referring to FIGS. 2B and 2C of the drawings, the landing gear cylinders 15 are operated by manipulation of the landing gear control 29 to raise and lower the landing gear 14 and selectively engage the blade angle plate 19, pivoted to the frame 2 at the plate pivot pin 20, with the working support surface 50. Accordingly, in FIG. 2B the blade angle plate 19 is shown in raised, transportation or blade-sharpening and dressing position, with the extending blade 22 spaced from the working support surface 50. This position of the blade angle plate 19 and the blade 22 is facilitated by operating the crank 27 to telescope the telescoping tubing 25 into the base tubing 24, as further illustrated in FIG. 2B. Under circumstances where it is desired to adjust the blade angle plate 19 to the desired working angle and the blade 22 into the functional floor-removing configuration, pivoted downwardly on the plate pivot pin 20, the crank 27 is initially operated to extend the telescoping tubing 25 from the base tubing 24 and force the blade 22 into contact with the working support surface 50 at a selected angle as illustrated in FIG. 2C. The landing gear control 29 is then manipulated by the operator to retract the cylinder pistons 16 in the respective landing gear cylinders 15 and raise the landing gear 14, to clear the working support surface and support the electric floor covering removal apparatus only on the blade 22 and the rear wheels 3.

Figure 3:
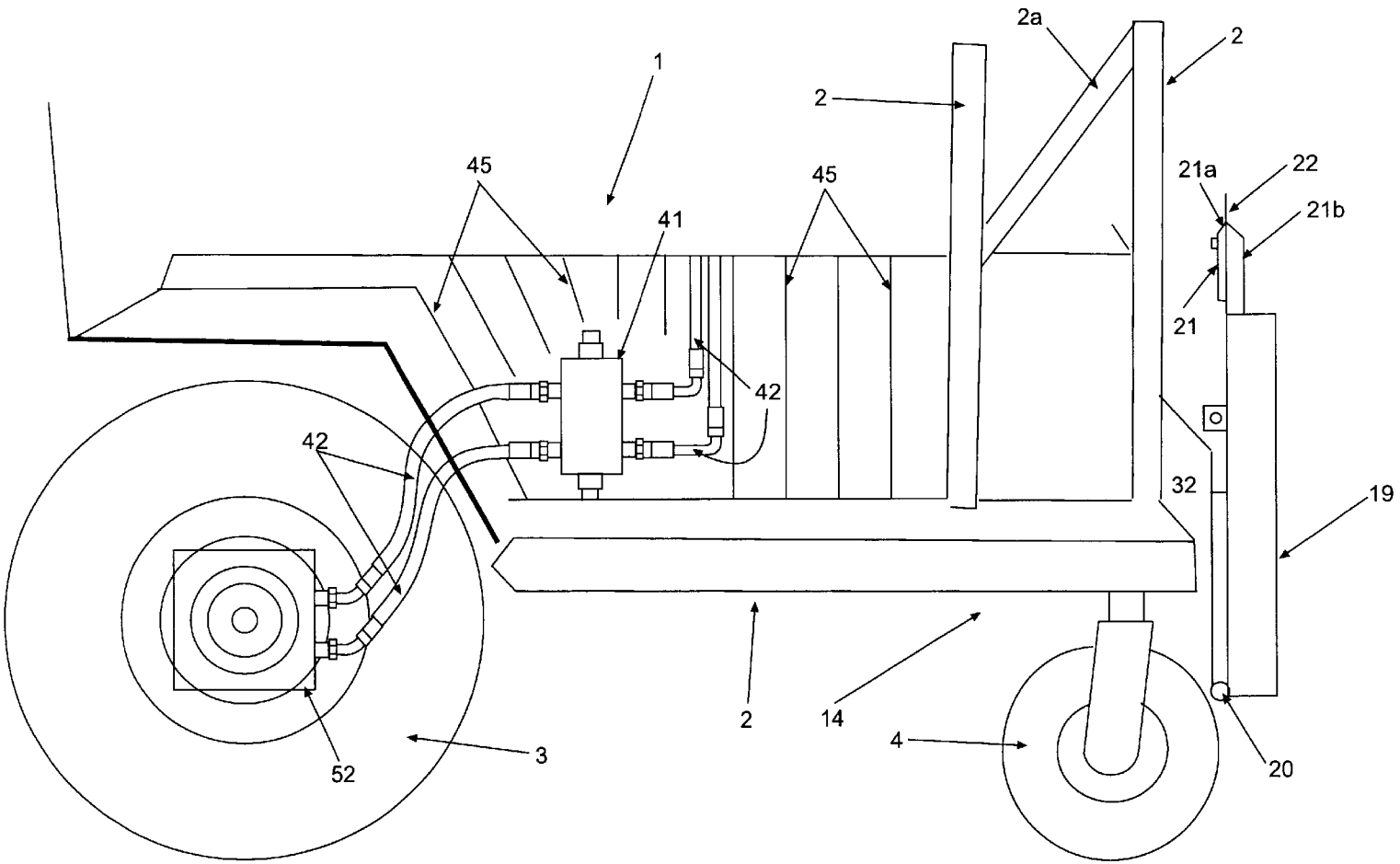
FIG. 3 is a side view, partially in section of the electric floor covering removal apparatus, more particularly illustrating a wheel motor, wheel motor hydraulic service lines and a cross-over relief valve element, as well as the blade assembly in fully folded and retracted configuration.
Figure 4:
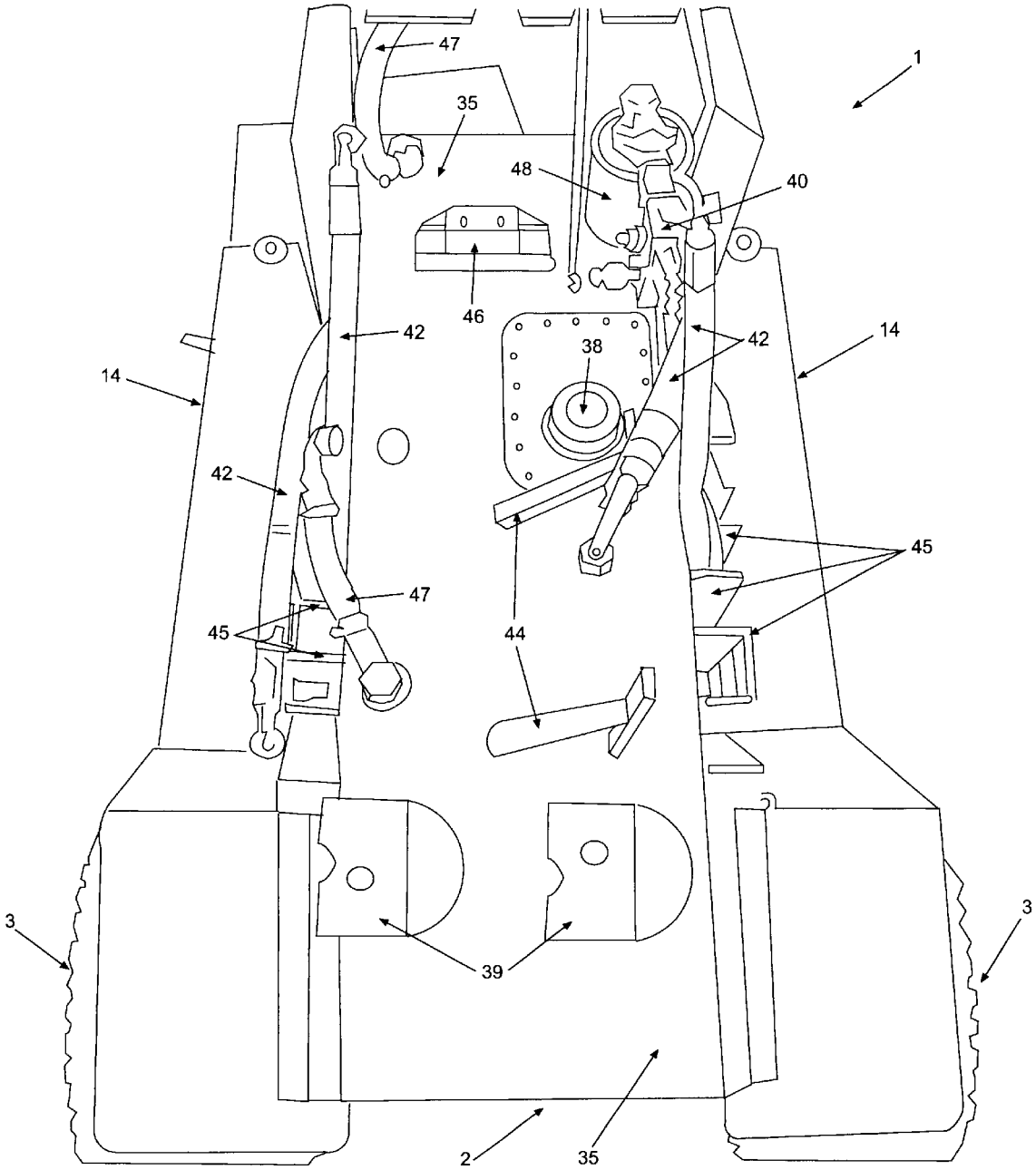
FIG. 4 is a perspective view of the rear portion of the electric floor covering removal apparatus illustrated in FIG. 1, with the shroud, housing or cowling removed, more particularly illustrating the hydraulic fluid reservoir, the hydraulic fluid return filter and other internal operating elements of the apparatus.
Figure 5:
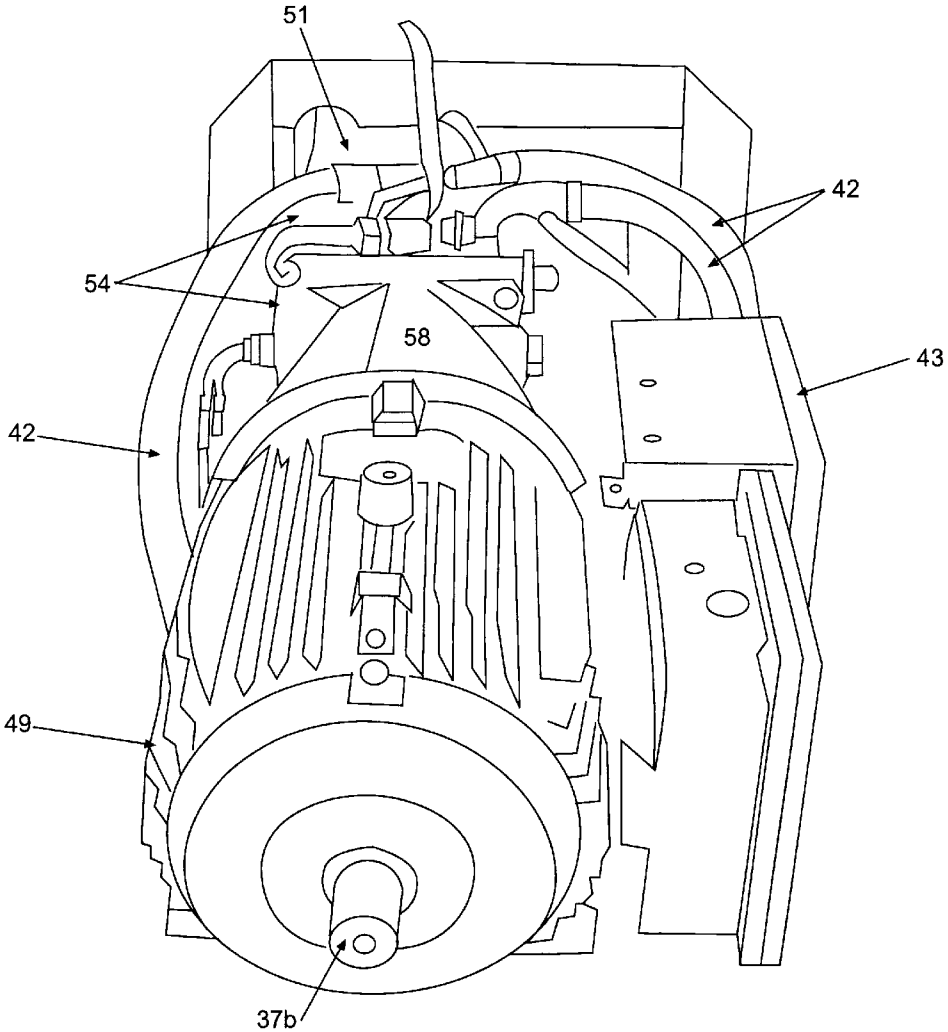
FIG. 5 is a rear perspective view of the electric motor, hydrostatic pump and hydraulic gear pump elements, along with various hydraulic service lines in the apparatus.
Figure 9:
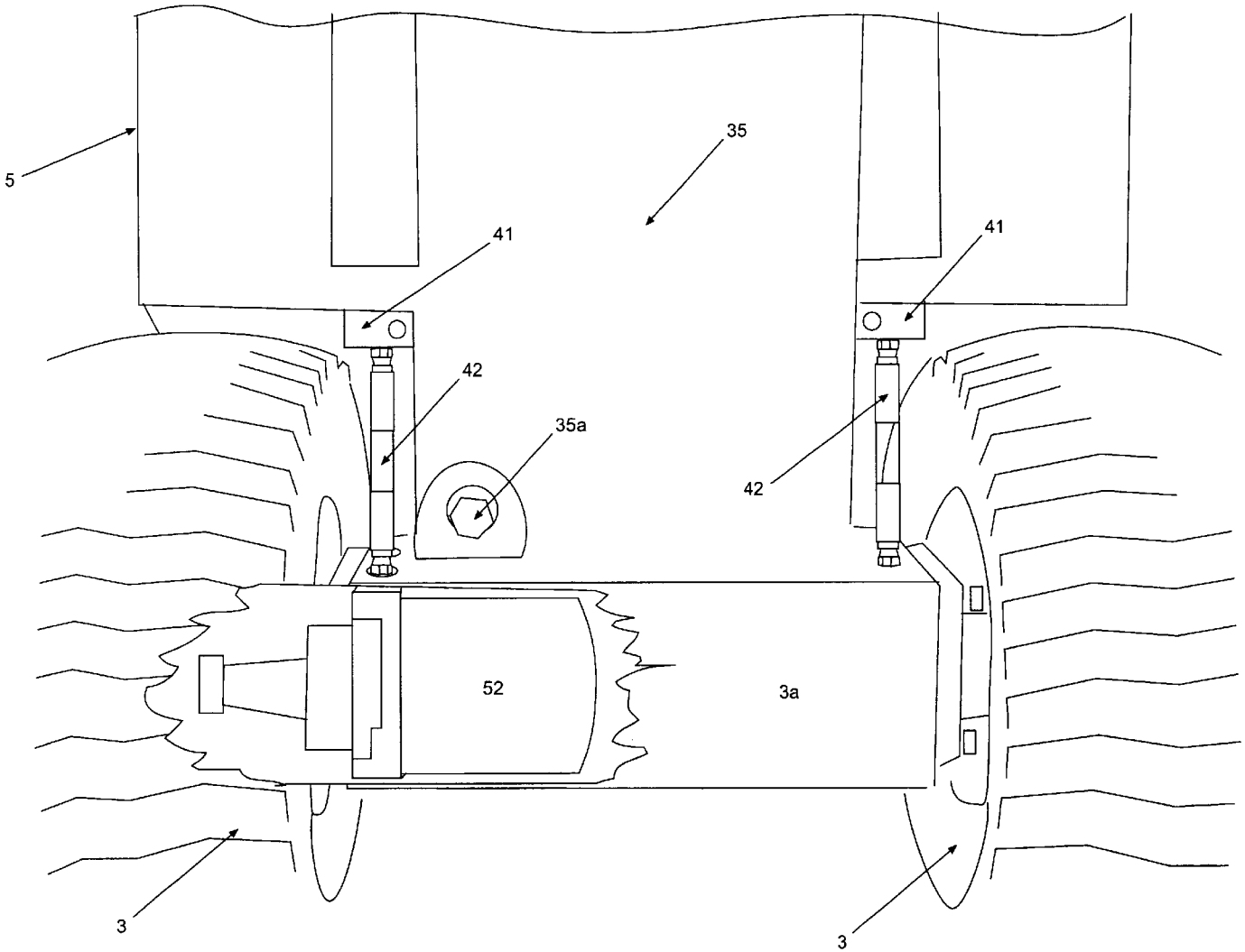
FIG. 9 is a bottom view of the electric floor covering removal apparatus, more particularly illustrating a wheel motor and wheel motor mount box axle, drain plug and the hydraulic fluid reservoir elements of the apparatus.

Referring now to FIGS. 3–9 of the drawings, in a preferred embodiment the electric floor covering removal apparatus 1 is typically fitted with a five horsepower, 220 volt, single phase, 30 amp, ground fault-compatible, TEFC electric motor 49, illustrated in FIG. 5, which mounts and drives the cooling fan 37 on the fan shaft 37*b*, as illustrated in FIG. 2A. The electric motor 49 also drives a pair of hydrostatic pumps 54, further illustrated in FIGS. 5, 6A and 7 and a hydraulic gear pump 51, illustrated in FIGS. 5, 6A, 6B and 7. The hydrostatic pumps 54 are typically variable-volume, over-center piston pumps and are hydraulically connected to corresponding wheel motors 52, each located in a wheel motor mount box axle 3*a*, as illustrated in FIG. 9, such that each wheel motor 52 can be independently operated by manipulation of one of the steering arms 9 and the hydrostatic pumps 54, as hereinafter further described. The hydrostatic pumps 54 are in turn, connected to the wheel motors 52 by means of wheel motor hydraulic lines 42, as illustrated in FIG. 3. As illustrated in FIGS. 3 and 9, in a preferred embodiment, a cross-over relief valve 41 is provided in each set of the wheel motor hydraulic lines 42, for controlling the hydraulic pressure to the wheel motors 52.

Figure 11:
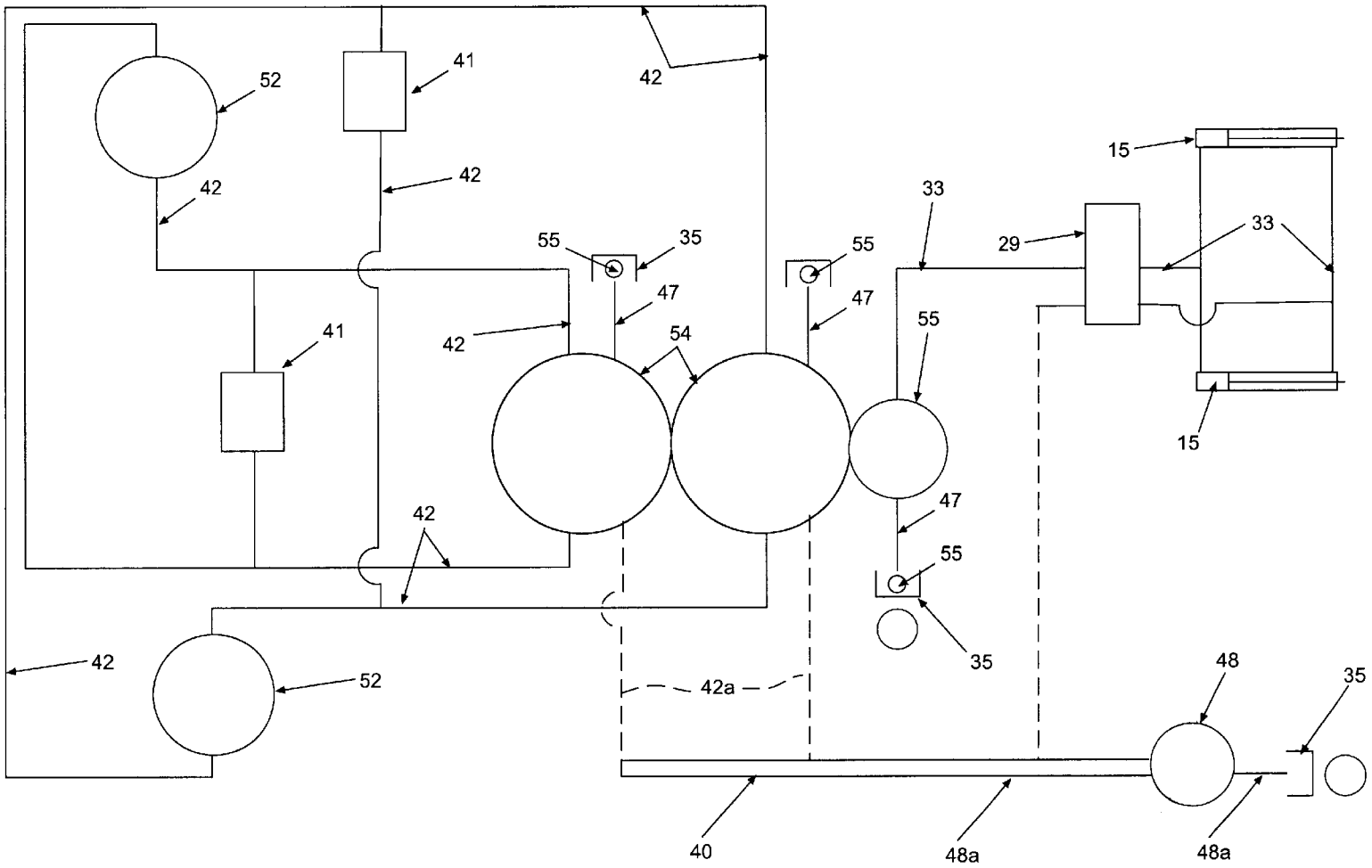
FIG. 11 is a schematic of a preferred hydraulic system for operating the electric floor covering removal apparatus illustrated in FIGS. 1–10 of the drawings.

As further illustrated in FIG. 4, the electric motor 49 is typically mounted on top of the hydraulic fluid reservoir 35 by means of resilient, automobile-type motor mounts 39 and the hydrostatic pumps 54 and hydraulic gear pump 51 are similarly mounted over the hydraulic fluid reservoir 35 by means of a resilient pump mount bracket 46. Cooling fins 45 typically extend from each side of the hydraulic fluid reservoir 35 and serve to dissipate heat from the hydraulic fluid stored in the hydraulic fluid reservoir 35 during operation of the electric floor covering removal apparatus 1. A bell housing 58 covers the electric motor 49-to-hydraulic gear pump 51 connection and electrical box supports 44 are mounted on the hydraulic fluid reservoir 35 and serve to mount a waterproof electrical box 43, which houses the necessary electrical components of the apparatus, as further illustrated in FIGS. 5, 6A and 6B. Both hydrostatic pumps 54 and the hydraulic gear pump 51 are coupled to linearly-aligned, coupled together shafts for minimizing mechanical power loss and facilitating operation by a smaller motor. A hydraulic fluid return filter 48 is also mounted on the hydraulic fluid reservoir 35 for filtering hydraulic fluid pumped by means of the hydrostatic pumps 54 to the wheel motors 52 and returning from the wheel motors 52, to the hydraulic fluid reservoir 35 through the filter return line 48*a* (FIG. 7). Accordingly, referring to FIGS. 1 and 7 and FIG. 11 of the drawings, under circumstances where it is desired to operate the landing gear cylinders 15 to raise or lower the landing gear 14, the hydraulic gear pump 51 is activated by manipulating the landing gear control 29, which is typically a 4-way, open center spool valve, such that hydraulic fluid flows from the hydraulic reservoir 35 through the suction hydraulic line 47 and is pumped by the hydraulic gear pump 51 to the landing gear cylinders 15 through the control hydraulic lines 33, to extend and retract the respective cylinder pistons 16, for the purpose. The hydraulic fluid from the landing gear cylinders 15 is then pumped through the control hydraulic lines 33 to the return line manifold 40, illustrated in FIG. 8, and from there back into the hydraulic fluid reservoir 35. As further illustrated in FIG. 8, an access port 38*a*, provided on the hydraulic fluid reservoir 35, is fitted with a filler spout fitted with a filler cap 38 for adding hydraulic fluid to the hydraulic fluid reservoir 35, as necessary. Moreover, the hydraulic fluid return filter 48 is accessed by an oil filter access door 34, provided in the cowling 5. A pair of case drain lines 42*a* extend from the hydrostatic pumps 54 to the return line manifold 40 for returning pump lubricating hydraulic fluid to the hydraulic fluid reservoir 35.

Figure 6A:
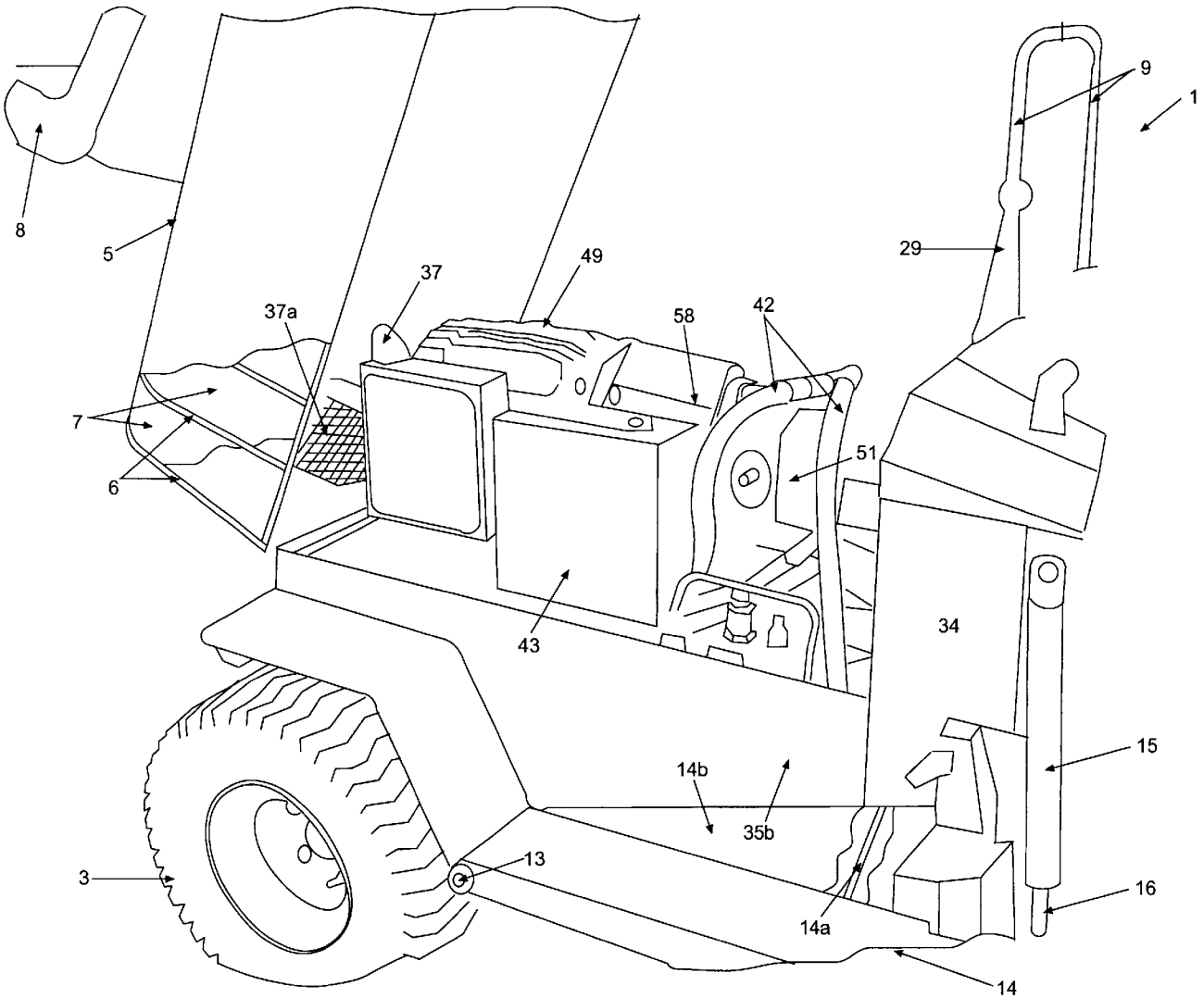
FIG. 6A is a perspective view, partially in section, of the electric floor covering removal apparatus illustrated in FIG. 1, with the shroud or housing partially removed, more particularly illustrating the TEFC electric motor, hydrostatic pumps, electric gear pump and a pair of the wheel motor hydraulic service lines, as well as the landing gear control and the steering arms of the apparatus.
Figure 6B:
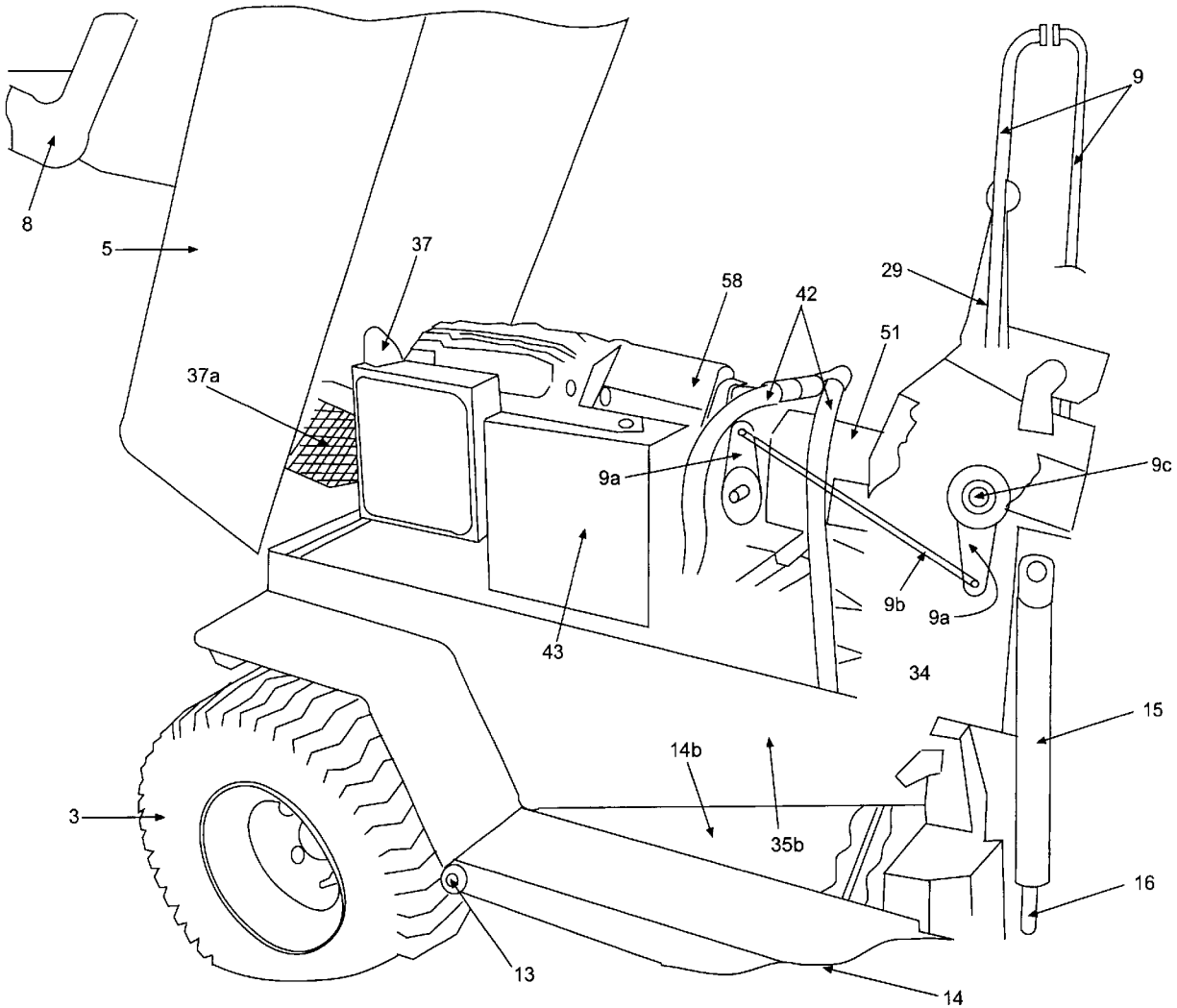
FIG. 6B is a front perspective view, partially in section, of the electric floor covering removal apparatus illustrated in FIG. 1, more particularly illustrating the steering arm couplings and steering arm rod elements attached to the steering arms for independently operating the respective hydrostatic pumps and wheel motors in the apparatus.
Figure 7:
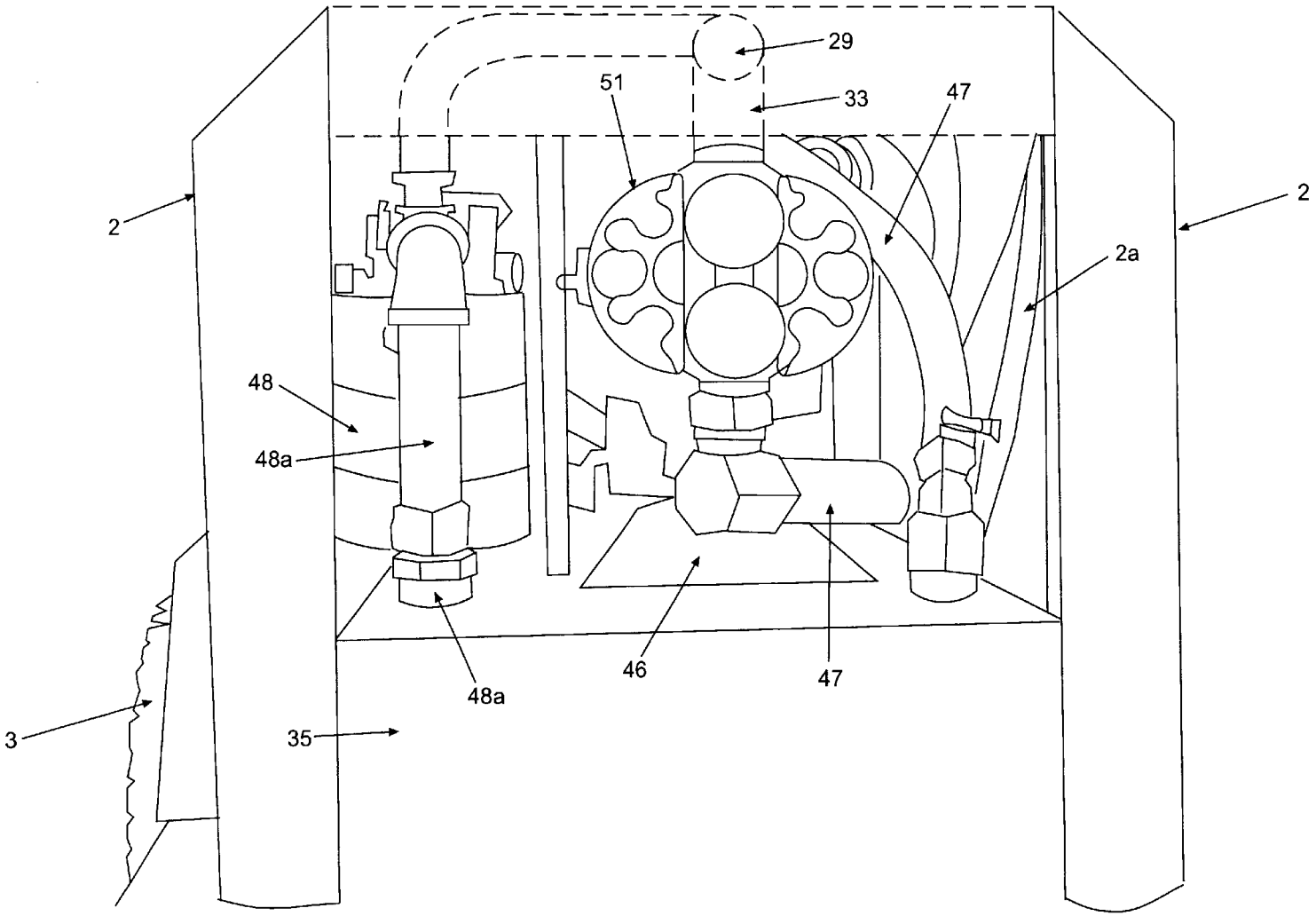
FIG. 7 is a front view of the electric floor covering removal apparatus, more particularly illustrating hydraulic gear pump suction hydraulic service lines, along with hydraulic fluid return filter elements of the apparatus.
Figure 8:
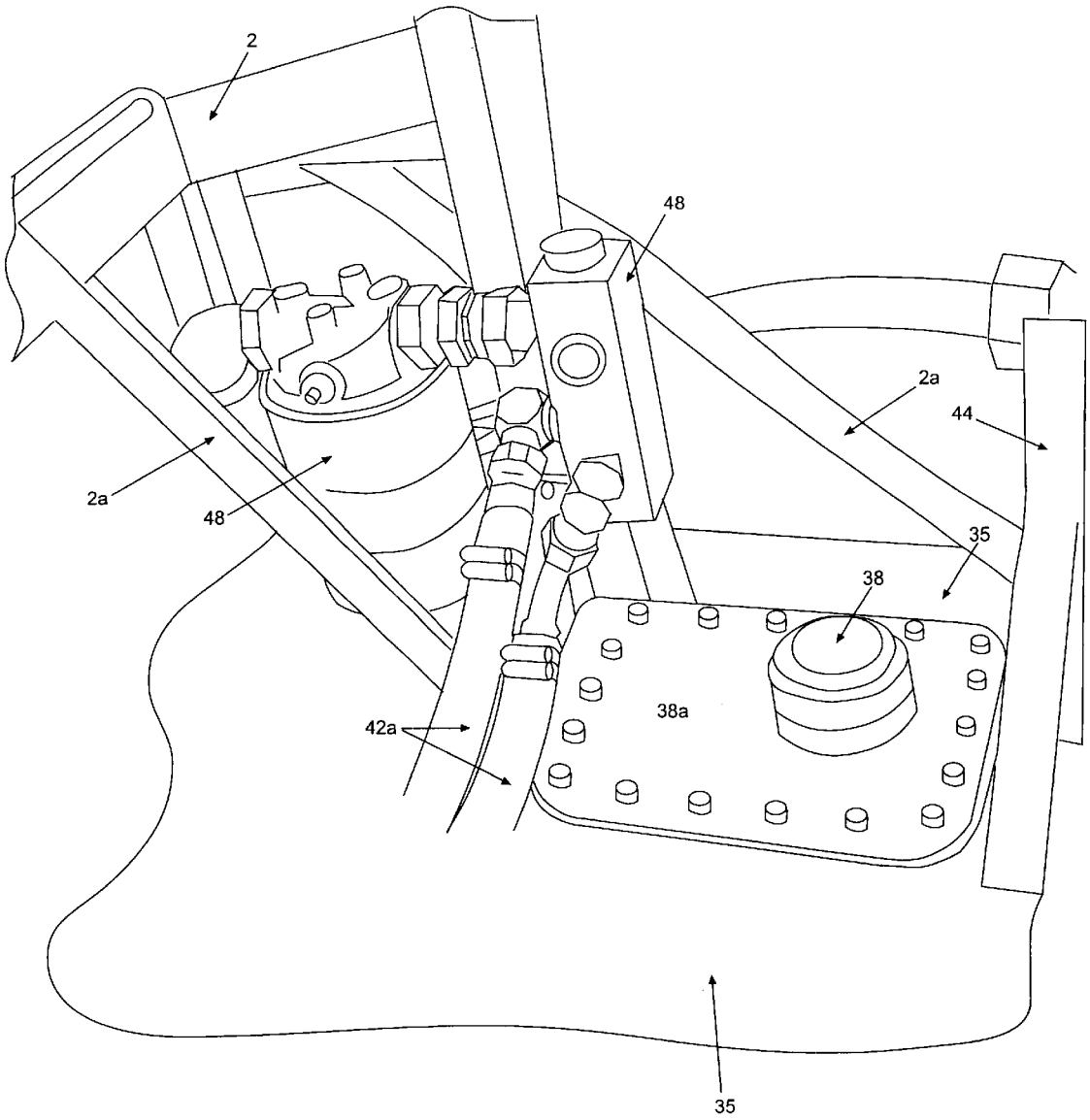
FIG. 8 is a perspective view of the return line manifold and accompanying hydrostatic pump case drain lines, the motor hydraulic service lines, along with an access port for accessing the hydraulic fluid reservoir, and a filler cap.

Referring now to FIGS. 6A and 6B of the drawings, in a preferred embodiment of the invention the cowling 5 is pivotable and fitted with a cowling frame 6, which includes cowling insulation 7, to insulate the driver (not illustrated) who sits in the drivers seat 8, from the heat generated in the hydraulic fluid reservoir 35. As heretofore described, this heat is also dissipated by the cooling fins 45 illustrated in FIG. 4 as air flows through the cowling 5 and over the hydraulic fluid reservoir 35, by operation of the cooling fan 37, in order to provide additional comfort for the driver and extend the life of the TEFC electric motor and all hydraulic components, during operation of the electric floor covering removal apparatus 1. More comfort is assured the driver of the apparatus by means of the inflatable, or foam-filled pneumatic tires on the rear wheels 3, which not only serve to provide comfort for operation but also to allow additional traction during removal of the floor covering on the supporting surface 50, especially under circumstances where the floor covering is one or more layers of tile which is glued to the supporting surface 50.

Referring again to FIG. 6B of the drawings, in another preferred embodiment of the invention the steering arms 9 are each attached to a separate front steering arm coupling 9*a*, which pivots on a pivot bearing 9*c* and mounts an elongated steering arm rod 9*b*, that extends from the steering arm coupling 9*a* to a rear steering arm coupling 9*d*, connected to the respective hydrostatic pumps 54. In this way, the operator can manipulate the respective steering arms 9 and operate the corresponding hydrostatic pumps 54 and the wheel motors 52 independently of each other, for accurate and smooth operation of the electric floor covering removal apparatus 1, in either forward or reverse direction. Sharp ("zero radius") turning of the electric floor covering removal apparatus 1 on its axis in either direction can therefore be achieved by pushing one of the steering arms 9 forward and the other rearwardly to separately activate the corresponding hydrostatic pumps 54 and the connected wheel motors 52 in opposite directions, as heretofore described.

Figures 10, 10A:
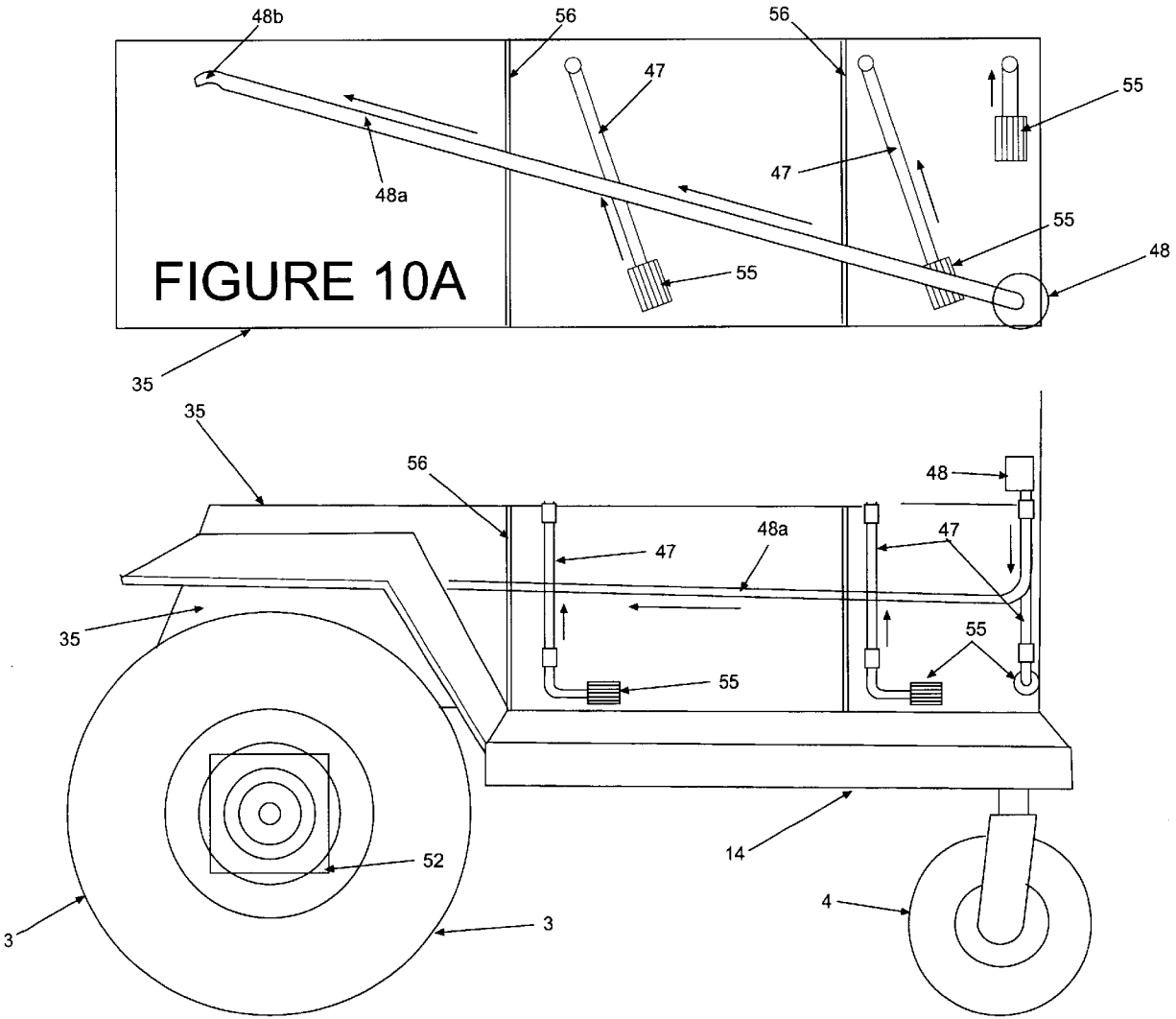
FIG. 10 is a side view of the hydraulic fluid reservoir, more particularly illustrating various suction filter elements and return lines in the reservoir.
FIG. 10A is a top view of the hydraulic fluid reservoir, more particularly illustrating the suction filter elements and return lines illustrated in FIG. 10.

Referring now to FIGS. 7, 10 and 10A, the hydraulic fluid reservoir 35 is fitted with suction filters 55 for serving the various hydraulic lines that operate in cooperation with the hydraulic fluid return filter 48 and insure that small particles of metal or trash are filtered from the hydraulic fluid, both when the hydraulic fluid is pumped from the hydraulic fluid reservoir 35 by the hydrostatic pumps 54 and the hydraulic gear pump 51 and when the hydraulic fluid returns to the hydraulic fluid reservoir 35 through the hydraulic fluid return filter 48. Furthermore, in a preferred embodiment, hydraulic fluid that is returned from the hydraulic fluid return filter 48 to the hydraulic fluid reservoir 35, empties into the reservoir through the filter return line 48*a* at a discharge end 48*b* which is distanced from the suction filters 55 and is located beyond the spaced-apart, perforated, flow-dampening plate baffles 56. This arrangement serves to more efficiently cool the incoming hydraulic fluid before it is again re-circulated.

Referring again to FIG. 11 of the drawings, the schematic flow diagram is illustrated, wherein the path of the hydraulic fluid from the hydrostatic pumps 54 and the hydraulic gear pump 51 to the wheel motors 52 and the landing gear cylinders 15, respectively, is diagrammed. For example, referring to FIGS. 1, 2 and 11, under circumstances where it is desired to operate the electric floor covering removal apparatus 1 in the forward direction, both of the steering arms 9 are pushed forward, thus operating the respective steering arm couplings 9*a*, connected by the steering arm rods 9*b*, and the hydrostatic pumps 54, to energize both of the wheel motors 52 in the smooth, concise forward direction by a flow of hydraulic fluid from the hydraulic fluid reservoir 35, through the pressurized runs of the wheel motor hydraulic lines 42 and the cross-over relief valves 41, and back to the hydrostatic pumps 54 and the hydraulic fluid reservoir 35, through the return segments of the hydraulic lines 47. Similarly, under circumstances where it is desired to raise the landing gear 14 from the position illustrated in FIG. 2B to the functional position illustrated in FIG. 2C and higher, the landing gear control 29 is manipulated in the reverse direction to cause hydraulic fluid to flow from the hydraulic fluid reservoir 35, through the control hydraulic lines 33 and the hydraulic gear pump 51 and to the landing gear cylinders 15, to retract the respective cylinder pistons 16 in the landing gear cylinders 15 and effect the desired forcing of the blade 22 against the working support surface 50, as heretofore described. This action can be accomplished without disturbing the pre-adjusted angle of incidence of the blade 22 with the working support surface 50. Furthermore, when it is desired to turn the electric floor covering removal apparatus 1 on its own axis in a selected direction, the appropriate steering arms 9 can be pushed individually forwardly and rearwardly simultaneously to smoothly energize the hydrostatic pumps 54 in opposite modes and cause the wheel motors 52 to rotate in opposite directions, thus causing the respective rear wheels 3 to spin the electric floor covering removal apparatus 1 in a "zero turn radius" on its axis. More gradual turns can be affected by less abrupt movements of the steering arms 9 forwardly and rearwardly, as desired.

It will be appreciated by those skilled in the art that the electric floor covering removal apparatus of this invention is characterized by convenience, utility and safety in operation, as well as optimum performance characteristics in removing tile and carpet from the floors of multi-story buildings due, in part, to elevator and doorway access. The apparatus is easy to operate, has a low center-of-gravity, is water-resistant to allow ease in washing as necessary to comply with asbestos abatement regulations; and lubricating points and filters are easily accessible. Power from an electrical source is introduced into the electrical box 43 through the power cord 11, where it is typically reduced from 220 volts to 12 volts and 24 volts, by a pair of transformers (not illustrated). The light 28*a* and an on-off switch and indicator light 59 are typically wired into the 12 volt circuit, while a motor-control relay (not illustrated) and the seat interlock switch 57 are typically wired into the 24 volt circuit. The on-off switch indicator light 59 indicates a power-on condition, even when the driver steps down from the machine, for safety purposes. Furthermore, since the apparatus is typically operated by an electric motor 49, there are no toxic fumes emitted in closed spaces inside the structure to present a health hazard. Power requirements are reduced when compared to prior art devices due to more efficient mechanical power transmission and the use of hydrostatic pumps. Moreover, operator comfort is insured by the cowling insulation 7 in the cowling frame 6 and by the provision of inflatable or foam-filled tires on the rear wheels 3, as well as through driver-operation of the power cord boom 10, to facilitate uninterrupted removal of various floor coverings from the supporting surface 15 with minimum labor, by serpentine traversal of the working support surface 15 with alternate movements of the power cord boom 10 to handle the power cord 11. Quick and easy deployment of the landing gear 14 into the downward, transporting mode and into the upright, functional configuration for removing the floor covering is effected by operation of the landing gears cylinders 15 and precise, graduated, smooth forward and reverse motion of the electric floor covering removal apparatus 1 is facilitated by operation of the steering arms 9 and the respective hydrostatic pumps 54 and corresponding wheel motors 52. Additional operator comfort and operation and acceptable temperatures of the hydraulic fluid and hydraulic fluid reservoir 35 is effected by means of the cooling fan 37, which pulls air constantly through the fan grill 37*a*, over and around the totally enclosed electric motor 49 and hydraulic fluid reservoir 35, where heat is dissipated by means of the cooling fins 45.

It is understood that while for most applications, an electric motor of the design described above is desirable for use in occupied structures, under circumstances where the structure is not occupied, as in open buildings or the like (e.g. pre-demolition) the electric motor can be replaced by a diesel motor, properly sized for the purpose. The floor covering removal apparatus of this invention is designed to provide optimum operator safety, comfort and operating convenience, as well as minimal training time. The apparatus can be operated by one man and presents no emission or operational hazard for workers in the area.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An electric floor covering removal apparatus comprising a frame; a motor mounted on said frame; a landing gear pivotally carried by said frame and a pair of front wheels pivotally and rotatably mounted on said landing gear; a hydraulic fluid reservoir provided on said frame for containing a supply of hydraulic fluid; a pair of rear wheels rotatably and independently carried by said frame and a pair of hydraulic wheel motors connected to said rear wheels, respectively, in independently driving relationship; a pair of hydrostatic pumps connected to said hydraulic fluid reservoir and operably connected to said motor and said hydraulic wheel motors for independently operating said rear wheels; a floor covering removal apparatus provided on said frame for removing a floor covering from a surface responsive to operation of said motor, said hydraulic wheel motors and said rear wheels when said floor covering removal apparatus engages the floor covering; a hydraulic gear pump mounted on said frame and a pair of hydraulic cylinders operably connected to said hydraulic gear pump and connected to said frame and said landing gear for selectively extending and retracting said hydraulic cylinders and raising and lowering said landing gear with respect to said frame, responsive to operation of said hydraulic gear pump.

2. The electric floor covering removal apparatus of claim 1 comprising a pair of steering arms mounted on said frame and operably connected to said hydrostatic pumps for independently operating said hydrostatic pumps, said hydraulic wheel motors and said rear wheels.

3. The electric floor covering removal apparatus of claim 1 comprising a landing gear control mounted on said frame and operably connected to said hydraulic gear pump for selectively energizing said hydraulic cylinders and raising and lowering said landing gear with respect to said frame.

4. The electric floor covering removal apparatus of claim 3 comprising a pair of steering arms mounted on said frame and operably connected to said hydrostatic pumps for independently operating said hydrostatic pumps, said hydraulic wheel motors and said rear wheels.

5. The electric floor covering removal apparatus of claim 1 comprising a fan operably connected to said motor for cooling said hydraulic fluid in said hydraulic fluid reservoir.

6. The electric floor covering removal apparatus of claim 5 comprising a pair of steering arms mounted on said frame and operably connected to said hydraulic pumps for independently operating said hydrostatic pumps, said hydraulic wheel motors and said rear wheels.

7. The electric floor covering removal apparatus of claim 5 comprising a landing gear control mounted on said frame and operably connected to said hydraulic gear pump for selectively energizing said hydraulic cylinders and raising and lowering said landing gear with respect to said frame.

8. The electric floor covering removal apparatus of claim 7 comprising a pair of steering arms mounted on said frame and operably connected to said hydraulic pumps for independently operating said hydrostatic pumps, said hydraulic wheel motors and said rear wheels.

9. The electric floor covering removal apparatus of claim 1 comprising an adjusting mechanism connected to said frame and said floor covering removal apparatus for adjusting said floor covering removal apparatus with respect to said frame.

10. The electric floor covering removal apparatus of claim 9 comprising a pair of steering arms mounted on said frame and operably connected to said hydraulic pumps for independently operating said hydrostatic pumps, said hydraulic wheel motors and said rear wheels.

11. The electric floor covering removal apparatus of claim 9 comprising a landing gear control mounted on said frame and operably connected to said hydraulic gear pump for selectively energizing said hydraulic cylinders and raising and lowering said landing gear with respect to said frame.

12. An electric floor covering removal apparatus comprising a frame; an electric motor mounted on said frame; a landing gear pivotally carried by said frame and a pair of front wheels pivotally and rotatably mounted on said landing gear; a hydraulic fluid reservoir provided on said frame for containing a supply of hydraulic fluid; a pair of rear wheels having inflatable tires rotatably and independently carried by said frame and a pair of hydraulic wheel motors connected to said rear wheels, respectively, in independently driving relationship; a pair of hydrostatic pumps connected to said hydraulic fluid reservoir and driven by said electric motor, said hydrostatic pumps operably connected to said hydraulic wheel motors for independently operating said rear wheels; a pair of steering arms mounted on said frame and operably connected to said hydrostatic pumps for independently operating said hydrostatic pumps and said hydraulic wheel motors and said rear wheels; a floor covering removal blade adjustably provided on said frame, for removing floor tile from a floor responsive to manipulation of said steering arms and operation of said electric motor, said hydraulic wheel motors and said rear wheels when said floor covering removal blade engages the floor; a hydraulic gear pump mounted on said frame and a pair of hydraulic cylinders operably connected to said hydraulic gear pump and connected to said frame and said landing gear for selectively extending and retracting said hydraulic cylinders and raising and lowering said landing gear with respect to said frame, responsive to operation of said hydraulic gear pump; and a landing gear control mounted on said frame and operably connected to said hydraulic gear pump for selectively energizing said hydraulic cylinders and raising and lowering said landing gear with respect to said frame.

13. The electric floor covering removal apparatus of claim 12 comprising a fan operably connected to said electric motor for cooling said hydraulic fluid in said hydraulic fluid reservoir.

14. An electric floor covering removal apparatus comprising a frame; a 220 volt, single-phase electric motor horizontally mounted on said frame; a landing gear pivotally attached to said frame; and a pair of caster wheels pivotally and rotatably mounted on said landing gear; a hydraulic fluid reservoir provided on said frame for containing a supply of hydraulic fluid; a housing removably covering said frame and a driver's seat mounted on said housing for accommodating an operator; a pair of rear wheels rotatably and independently carried by said frame, respectively, and pneumatic tires provided on said rear wheels; a pair of hydraulic wheel motors connected to said rear wheels, respectively, in independently driving relationship; a pair of hydrostatic pumps connected to said hydraulic fluid reservoir and operably connected to said electric motor and said hydraulic wheel motors for independently operating said rear wheels; a floor covering removal apparatus adjustably mounted on said frame for removing a floor covering from a surface responsive to operation of said electric motor, said hydraulic wheel motor and said rear wheels when said floor covering removal apparatus engages the floor covering; a hydraulic gear pump mounted on said frame and a pair of hydraulic cylinders operably connected to said hydraulic gear pump and connected to said frame and said landing gear for selectively extending and retracting said hydraulic cylinders and raising and lowering said landing gear with respect to said frame, responsive to operation of said hydraulic gear pump; and a landing gear control mounted on said frame and operably connected to said hydraulic gear pump for selectively energizing said hydraulic cylinders and raising and lowering said landing gear with respect to said frame.

15. The electric floor covering removal apparatus of claim 14 comprising a fan operably connected to said electric motor for cooling said hydraulic fluid in said hydraulic fluid reservoir.

* * * * *